US005899427A

United States Patent [19]

Schuite

[11] Patent Number: 5,899,427

[45] Date of Patent: May 4, 1999

[54] SUSPENSION AND SECURING SYSTEM

[76] Inventor: Johannes Leopold Boudewijn Schuite, Sir Winston Churchilllaan 945, 2286 AB Rijswijk, Netherlands

[21] Appl. No.: 08/902,573

[22] Filed: Jul. 29, 1997

[30] Foreign Application Priority Data

Jul. 29, 1996 [NL] Netherlands ..... 1003701

[51] Int. Cl.[6] ..... A47H 1/10

[52] U.S. Cl. ..... 248/317; 248/489

[58] Field of Search ..... 248/228.2, 230.2, 248/317, 475.1, 489

[56] References Cited

U.S. PATENT DOCUMENTS

| | | | |
|---|---|---|---|
| 1,343,855 | 6/1920 | Tyler | 248/489 |
| 3,686,622 | 8/1972 | Bonhomme | 439/723 |
| 4,012,023 | 3/1977 | Melanson | 248/489 |
| 4,775,127 | 10/1988 | Nakamura | 248/489 |
| 5,178,355 | 1/1993 | Herzig | 248/489 |

FOREIGN PATENT DOCUMENTS

| | | |
|---|---|---|
| 0237409 | 9/1987 | European Pat. Off. . |
| 0475910 | 3/1992 | European Pat. Off. . |
| 0640309 | 3/1995 | European Pat. Off. . |
| 8900554 | 10/1990 | Netherlands . |

*Primary Examiner*—Ramon O. Ramirez
*Assistant Examiner*—Robert Lipcsik
*Attorney, Agent, or Firm*—Ladas & Parry

[57] ABSTRACT

Suspension and securing system for a painting, a lamp or the like or for securing sheets of paper. The system includes a U-shaped rail (2) of which a leg (4) has an arm (6) for forming a supporting surface (7). Situated above the supporting surface is an application surface (8) formed by a portion (9) of the leg so as to provide for an insertion space (10). A securing apparatus (11) includes a supporting element (12) and a bearing member (13). The supporting element is proportioned such that it can pivot between one leg (5) and the arm (6) of another leg (4). A projection (14) of the securing apparatus (11) has a shape fitting into the insertion space (10) so that this projection can be disposed in the insertion space with a surface (15) thereof lying against the leg (5) of the rail.

11 Claims, 2 Drawing Sheets

SUSPENSION AND SECURING SYSTEM

The invention relates to a suspension and securing system for suspending a painting, a work of art, a board, a lamp or the like and/or for securing a sheet of paper and the like, said system comprising an insertion beam and a securing means which is to be arranged therein.

It is known for instance, to construct the insertion beam as a U-shaped rail of which the one vertical leg is secured to a wall, so that an inverted U-shaped securing means can be slid over the other leg. From the free leg of the securing means an object can then be suspended. The drawback with this system is that when unintentionally pushing the securing means upwards while suspending an object, the securing means may be released from the insertion beam and may fall down.

It is also known to use a C-shaped rail as an insertion beam wherein a T-section can be arranged of which the leg can be connected to the object to be suspended. A drawback with this system is that the T-section has to be slid into the rail from the side so that the latter has to be freely accessible at at least one end. Even then, however, it is not possible for instance to suspend a painting from the same rail between two paintings which are already there. This could be provided for by making the rail sufficiently flexible so that the suspending means can be pressed into it by pushing away the legs of the rail. This, however, will entail that the bearing power of the system is limited since its proportions have to be kept as small as possible, because of which the pressing apart of the legs will also be relatively easily possible. The latter can present a drawback particularly when it concerns heavier objects such as display cases, cupboards and many other objects.

It is an object of the invention to provide an improved suspension system.

It is another object of the invention to provide a suspension system with which a sheet of paper and the like can also be secured.

Another object of the invention is providing a suspension system which has an aesthetic appearance.

Yet another object of the invention is providing a suspension system with as few parts as possible.

According to the invention, one or more of these objects are achieved with a suspension and securing system for suspending a painting, a work of art, a board, a lamp or the like and/or for securing a sheet of paper and the like, said system comprising an insertion beam and a securing means which is to be arranged therein, said insertion beam comprising a rail which has a substantially inverted U-shape in cross section, with a web, a first leg and a second leg, said first leg having an insertion space near its end, with an opening directed at the second leg, and the securing means comprising an elongated supporting element and bearing mean connected thereto, said supporting element having a longitudinal axis which when placed in the rail is parallel to the longitudinal axis of the rail and said supporting element having such proportions in cross section that, when in a position pivoted from its working position around its longitudinal axis, it can be inserted into the rail just between the first and second leg, and said supporting element having a projection which can be inserted in the insertion space of the first leg when the supporting element is pivoted into the working position, wherein the portion of the supporting element which is opposite the projection lies against the second leg of the rail.

Herewith it is achieved that the supporting element can easily be slid into the rail from below by keeping the securing means in the pivoted position, after which by pivoting back the securing means the projection on the supporting element can engage with the insertion space of the first leg and the portion lying opposite can support against the second leg of the rail. In the working position of the securing means the supporting element is thus locked in the rail.

By inserting the supporting element in the pivoted state the supporting element can be arranged at each and any place in an insertion beam.

When suspending paintings and the like there will never be the danger of the supporting element pivoting, because the securing means is always in the working position. Between the supporting element and the second leg a sheet of paper and the like can be secured.

Preferred embodiments of the rail and the supporting element are described in claims 2–5.

Preferably the supporting element of the securing means is provided with a bearing element which, when using the system for suspending a painting, a lamp or any other object, extends substantially vertically downwards, in the working position of the securing means.

By means of this bearing element the securing means can be brought in that position in which it can be slid into the rail from below and pivoted in order to secure it in the rail and vice versa.

According to a further elaboration of the invention it can be provided for that at least the second leg of the rail extends above the web of the rail and that the portion of the leg which extends above the web is provided with means for securing the rail. Naturally, securing the rail to a wall, a moveable or non-moveable partition wall or any other suitable construction element will be thought of in particular.

Furthermore the free edge of the portion of the second leg which extends above the web of the rail can be connected to a strip substantially parallel to the web of the rail, in such a way that it results in a U-shaped space which is open to the outside situated between the web of the rail and said strip above the rail.

When the rail is used for suspending lamps, for instance electrical conductors can be arranged in this space, and the conductors can be connected to the lamps to be suspended. Naturally other parts such as cables can be arranged in the space as well. The hollow space can, as well as the hollow space remaining in the U-shaped rail itself, be used for arranging security means such as sources for emitting laser beams. In this way unauthorized acts can be detected.

In order to hide the cables or the like inserted in the space from view, it can be provided for that portions of the rail in themselves and/or of the strip connected to it have either recesses or projections, which by snapping in can work together with complementary portions of a covering means.

The covering means can thus be connected to the rail by snapping in so the open space formed above the rail can be closed afterwards.

Furthermore it can be provided for in particular that the covering means extends from the portion which closes the space further along the first leg of the rail and is provided with a lip on the lower edge, which lip can fall under the arm of the rail. The appearance of the unit can be further embellished by this. Moreover the lip in itself can be provided with snap-in means which work together with either a leg of the rail or an arm thereof.

There is also the possibility to arrange electrical conductors in the walls of the rail which automatically come into contact with the electrical conductors in the suspension means when this is put in its place in the rail. The securing means for instance can be directly connected to a lamp so that after suspending the lamp it is automatically connected to a power source.

The suspension system is very easy to employ so that for instance it can also be used with the building of stands at an exhibition and for many other purposes. The system can also be employed for securing sheets of paper wherein the rail is not secured to a wall or the like, while the strip connected to the securing means can be used as operating means of the system.

The invention will be exemplified by embodiments shown in the drawing, wherein.

Figure 1:
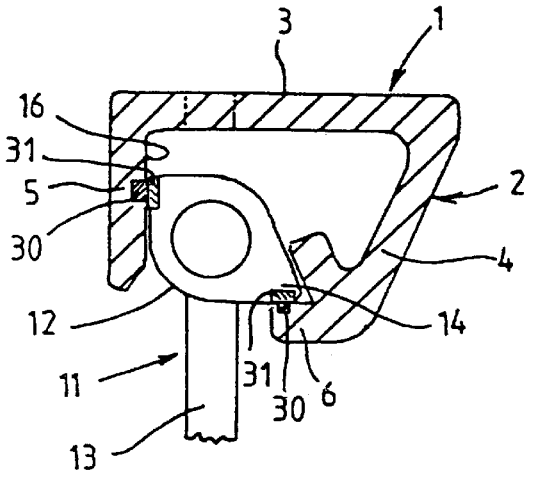
FIG. 1 shows a suspension system according to the invention in cross section.
Figure 2:
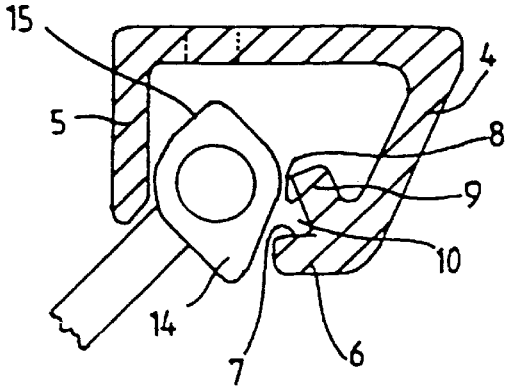
FIG. 2 shows the suspension system according to FIG. 1 but when the securing means is being arranged in the insertion beam.

As shown in FIG. 1 and 2 in particular the insertion beam 1 comprises of a substantially U-shaped rail 2 consisting of the web 3 and the legs 4 and 5. The leg 4 is at its free and provided with an arm 6 of which the upper surface 7 is designed as a supporting surface and which is directed towards the leg 5. Above the supporting surface 7 the application surface 8 is situated which is formed by a portion 9 of the leg 4 directed towards the inside. The supporting surface 7 and the application surface 8 together form a more or less V-shaped insertion space 10.

The securing means 11 comprises a supporting element 12 which is provided with a bearing element 13 which can have different shapes, for directly or indirectly connecting it to an object to be suspended. The bearing element can also be used for arranging the securing means 11 into the rail 2 when it is for instance used for securing sheets of paper. The supporting element 12 is provided with an projection 14 which has a shape complementary to the insertion space 10.

As appears from FIG. 2 in particular, the securing means 11 can, by pivoting, be brought between the leg 5 of the rail 2 and the arm 7 thereof, until the supporting element 12 of the securing means if so desired lies against the web 3 of the rail 2. The point of the projection 14 in any case now is situated above the arm 6. When the securing means is pivoted into the position as shown in FIG. 1 and is moved downwards out of the rail 2, the projection 14 will fall into the insertion space 10. The supporting element can be provided with a surface 15 which in the latter position will be entirely or partially lying against the inner surface 16 of the leg 5 of the rail 2.

Figure 5:
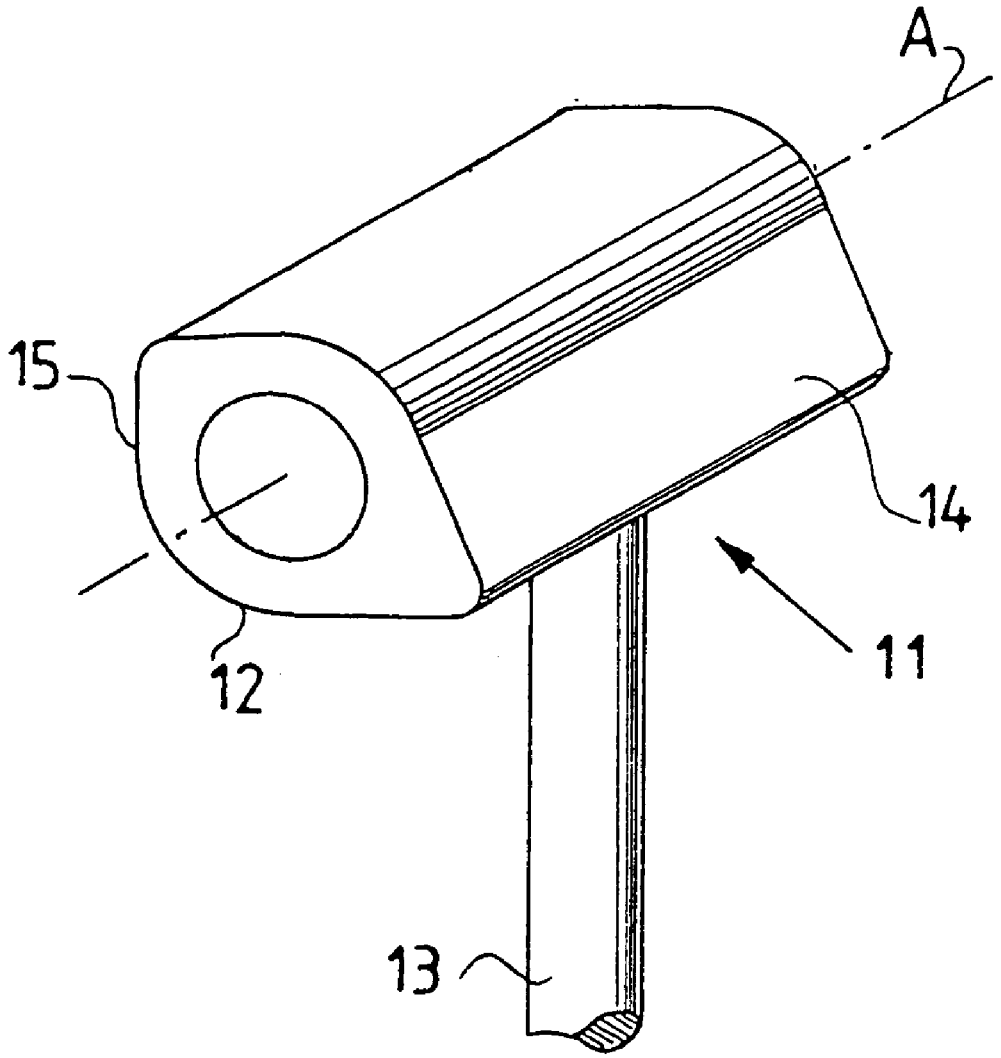
FIG. 5 is a perspective view of the securing means of FIG. 1.

As shown in FIG. 5, supporting element 12 of securing means 11 has a longitudinal axis A that is parallel to the longitudinal axis of the rail 2 when the support element is disposed in the rail in the position shown in FIG. 1.

Although in the drawing the leg 5 is represented as being at right angles to the web 3, it will be clear that the leg can also have a different angle to the web, or have a different shape. For instance, it can have a more conical shape if seen in cross section.

Figure 3:
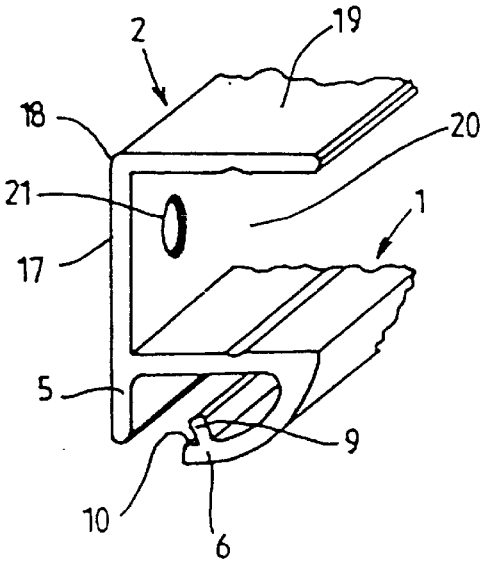
FIG. 3 shows schematically a perspective view of a portion of the insertion beam but of a slightly altered embodiment thereof.

FIG. 3 shows a slightly changed embodiment of a rail 2 wherein the leg 5 is provided with a portion 17 protruding outside of the web 3 of Which the upper edge 18 connects to a strip 19 thus resulting in a U-shaped space 20 which is open to the outside. In this space 20 electrical conductors, security devices and the like which are not further indicated, can be arranged. Alternatively, electrical conductors 30 can be arranged in walls of the rail 2 so that they come into contact with electrical conductors 31 in the suspension means 11.

The portion 17 which protrudes upwards can be provided with openings 21 wherein screws can be arranged for securing the rail 2 to a wall, a moveable or non-moveable partition wall or any other construction element.

Figure 4:
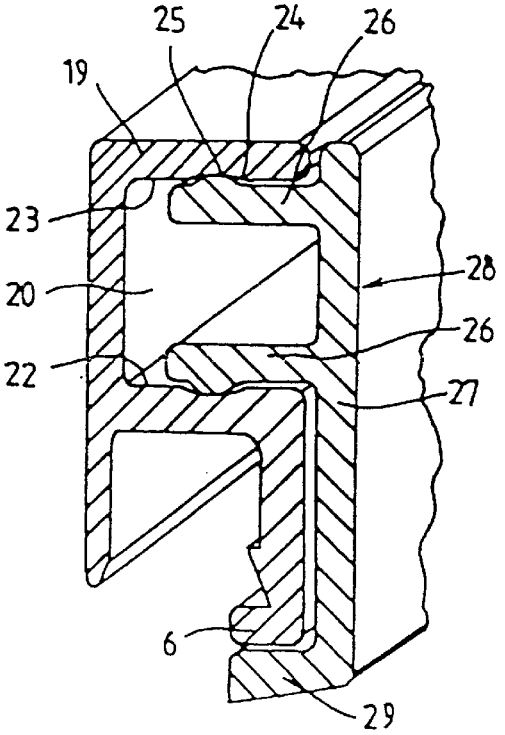
FIG. 4 shows schematically an elevation in accordance with FIG. 3 but of a further embodiment of the insertion beam and of a covering means arranged therein.

FIG. 4 shows the possibility to provide the surfaces 22 and 23 lying opposite each other of respectively the web 3 of the rail 2 and the strip 19 with recesses 24 for the insertion therein of projections 25 arranged on the legs 26 which are connected to a strip-shaped portion 27 of a covering means 28. By means of this covering means 28 the space 20 of the rail 2 can be closed so that the electrical conductors or the like, if there are any in there, are hidden from view. The strip-shaped portion 27 of the covering means 28 can be further extended along the leg 4 of the rail 2 and on the lower edge be provided with a lip 29 which can fall under the arm 6 of the rail 2. In this, way a aesthetic appearance of the entire suspension system can be obtained. If so desired the lip 29 and the arm 6 of the rail 2 can be provided with portions snapping into each other so that arranging such portions on the surfaces of the strip 19 and the leg 26 which lie against each other can be avoided. Naturally there is also the possibility of either leaving out the upper leg 26 or arranging said leg above the strip 19 and leaving out the lower leg 26.

While in the embodiments shown in the figures the insertion space 10 is always at the leg situated opposite the leg which will be connected to a construction element, this of course is not absolutely required.

The web 3 and/or the strip can also be formed in a different way so that the space 20 can be closed in a different way such as by a suspended lid.

It will be clear that only some possible embodiments of a device according to the invention have been shown in the drawing and described above and that many alterations can be introduced without departing from the inventive merit.

I claim:

1. Suspension and securing system for suspending a painting, a work of art, a board, a lamp or the like and/or for securing a sheet of paper and the like, said system comprising an insertion beam (1) and a securing means (11) which is to be arranged therein, said insertion beam comprising a rail (2) which has a substantially inverted U-shape in cross section, with a web (3), a first leg (4) and a second leg (5), said first leg (4) having an insertion space (10) near its end, with an opening directed at the second leg (5), and the securing means (11) comprising an elongated supporting element (12) and suspension and operating means connected thereto, said supporting element (12) having a longitudinal axis which when placed in the rail (2) is parallel to the longitudinal axis of the rail (2) and said supporting element having such proportions in cross section that, when in a position pivoted from its working position around its longitudinal axis, it can be inserted into the rail (2) just between the first and second leg (4, 5), and said supporting element (12) having a projection (14) which can be inserted in the insertion space (10) of the first leg (4) when the supporting element (12) is pivoted into the working position, wherein the portion of the supporting element (12) which is opposite the projection (14) lies against the second leg (5) of the rail (2).

2. Suspension and securing system according to claim 1, wherein the insertion space (10) is substantially V-shaped in cross section.

3. Suspension and securing system according to claim 2, wherein the insertion space (10) has a lower face (7) which is substantially horizontal during the use of the system.

4. Suspension and securing system according to claim 1, wherein the insertion space (10) is formed by an arm (6) provided at the end of the first leg (4), said arm (6) being substantially directed towards the second leg (5) and by a portion (9) directed towards the inside of the rail (2).

5. Suspension and securing system according to claim 1, wherein the shape of the projection (14) of the supporting element (12) is substantially complementary to the shape of the insertion space (10) of the first leg (4).

6. Suspension and securing system according to claim 1, wherein the supporting element (12) of the securing means (11) is provided with a bearing element (13), which when using the system for suspending an object, extends substantially vertically downwards in the working position of the securing means (11).

7. Suspension and securing system according to claim 1, wherein the second leg (5) of the rail (2) extends above the web (3) of the rail (2) and the portion of the second leg (5) which extends above the web is provided with means (21) for securing the rail (2).

8. Suspension and securing system according to claim 7, wherein the free upper edge (18) of the portion (17) of the second leg (5) extending above the web (3) of the rail (2), is connected to a strip (19) substantially parallel to the web (3) of the rail (2), in such a way that it results in a U-shaped space which is open to the outside situated between the web (5) of the rail and said strip (19) above the rail (2).

9. Suspension and securing system according to claim 8, wherein portions of the rail (2) in themselves and/or the strip (19) connected to it have either recesses (24) or projections, which by snapping in can work together with complementary portions (25) at a covering means (28).

10. Suspension and securing system according to claim 9, wherein the covering means (28) extends from the portion which closes the space (20), further along the first leg (4) of the rail (2) and is provided with a lip (29) on the lower edge, which lip can fall under the arm (6) of the rail (2).

11. Suspension and securing system according to claim 1, wherein in the walls of the rail (2) electrical conductors are arranged which automatically come into contact with the electrical conductors in the suspension means (11) when this is put in its place in the rail (2).

* * * * *